United States Patent [19]

Bressie

[11] Patent Number: 4,660,837

[45] Date of Patent: Apr. 28, 1987

[54] SETTER APPARATUS FOR GOLF TEES

[76] Inventor: Joe L. Bressie, 2648 Leta Mae, Farmers Branch, Tex. 75234

[21] Appl. No.: 861,318

[22] Filed: May 9, 1986

[51] Int. Cl.[4] ..... A63B 57/00

[52] U.S. Cl. ..... 273/32.5

[58] Field of Search ..... 273/32 B, 202, 32.5, 273/32 D, 162 C, 162 E; 294/19.1, 19.2; 81/44

[56] References Cited

U.S. PATENT DOCUMENTS

| | | | |
|---|---|---|---|
| 2,606,764 | 8/1952 | Mason | 273/32 |
| 2,609,198 | 9/1952 | Armstrong | 273/32 |
| 2,901,146 | 10/1955 | Powell, Jr. et al. | 221/190 |
| 3,074,719 | 1/1963 | McKee | 273/33 |
| 3,540,727 | 11/1970 | Hoe, Jr. | 273/33 |
| 3,658,331 | 4/1972 | Driscoll | 273/33 |
| 3,671,036 | 6/1972 | Rubino | 273/33 |
| 3,671,037 | 6/1972 | Murdock, Jr. | 273/33 |
| 4,142,719 | 3/1979 | Blood | 273/33 |
| 4,313,604 | 2/1982 | Baxter | 273/32 A |

*Primary Examiner*—Richard C. Pinkham
*Assistant Examiner*—T. Brown
*Attorney, Agent, or Firm*—Hubbard, Thurman, Turner & Tucker

[57] ABSTRACT

A golf tee setting apparatus for inserting and presetting the height of golf tee on which a golf ball to be supported is comprised of an all polymer plastic construction that includes a tubular sleeve-like body and a plunger internally displaceable within the body and adapted to releasably support a golf tee to be inserted. The body includes a pair of oppositely aligned longitudinal slots which in communication therewith are a plurality of separate apertures of a geometric configuration able to effect a longitudinal interlock with an appropriately shaped protrusion received therein. Extending connected from the plunger is a pair of elongated longitudinal arms each terminating at its distal end with a lateral protrusion adapted to be received in a selected one of the apertures. By inwardly squeezing a finger grip extending outward of each of the arms the protrusions can be displaced inwardly to release the interlock and enable the plunger to be adjustably positioned relative to the base plane of the body.

13 Claims, 5 Drawing Figures

SETTER APPARATUS FOR GOLF TEES

TECHNICAL FIELD

The field of art to which the invention pertains comprises the art of products utilized in the participation of the sport of golf.

BACKGROUND OF THE INVENTION

The sport of golf is widely and almost universally enjoyed by golfers around the world. Whether amateur or professional, a tee is customarily utilized for supporting the ball closely above the immediate ground level at the location from which the ensuing stroke is to be initiated. Most important, however, depending on depth of ground penetration, the tee can be and is utilized to establish the ball height selected by the golfer for placement of the ball at the optimum setting for the condition of play and golf club to be selected. The precise ball height to be selected is largely a judgement factor by the participant depending on such variables as the face size and loft angle of the golf club to be utilized for tee shot of the next stroke. Typically, a number nine iron calls for a low tee height and which height is progressively raised as lower numbered clubs are selected. Woods tend to require a higher tee setting because of their wide faces.

Typically, in the absence of products available for that purpose, tee height is determined on the basis of transverse finger spacing in which a selected number of fingers serve as a gauge in setting the height between the ball and ground. After addressing the ball, the tee can then be raised or lowered by the participant in correlation to the sweet spot of the selected club. Tee setter products for the purpose of controlling tee height are likewise known and utilized. Exemplifying the previously known products are the disclosures of prior U.S. Pat. Nos. 2,606,764; 2,609,198; 2,901,146; 3,074,719; 3,540,727; 3,658,331; 3,671,036; 3,671,037; 4,142,719; and 4,313,604.

While the tee setter apparatus of the foregoing patents have varying degrees of usefulness in aiding the golfer to effect desired tee height, they are generally characterized by a difficulty of use and/or a complexity of construction leading to a relatively high cost of manufacture. Whatever the difficulty or complexity of the prior devices, they have generally been unable to meet the demands of the marketplace for a tee setter apparatus which is easily handled, quick and easily adjustable and of relatively low cost to manufacture.

Despite recognition of the foregoing, a tee setter construction built to satisfy such requirements has not heretofore been available.

SUMMARY OF THE INVENTION

This invention relates to setter apparatus for a golf tee on which a golf ball is to be supported. More specifically, the invention relates to golf tee setter apparatus affording the versatility of embodying the features of being easily handled and lightweight, quick and easily adjustable to a selected tee height setting and of relatively low manufacturing cost so as to render the setter apparatus highly desirable and readily affordable for all those who participate in the sport.

The foregoing is achieved in accordance with the invention utilizing an elongated sleeve-like tubular body of predetermined longitudinal dimension and prefabricated preferably of molded durable polymer plastic.

The base of the body is flared outwardly to a ground engagement plane while its top or upper end is inwardly dished concavely for supporting a golf ball temporarily during ground insertion of a contained tee. Formed longitudinally in the body is a pair of oppositely aligned longitudinal slots each having a plurality of geometrically shaped apertures series arranged progressively in communication with the slots.

Slidably contained internally of the body is a molded polymer plastic plunger having a central recess in its underside constructed so as to be capable of effecting a releasable grip against the circumferential sides of a tee head inserted therein. Extending integrally from the plunger for longitudinal positioned placement thereof relative to the base plane of the body is a pair of resilient supported button-type finger tabs extending outward of said body slots and having protrusions shaped complementary to the body apertures. The protrusions are adapted to cooperate with individual pairs of said body apertures at opposite locations along the tube so as to effect a longitudinal interlock therebetween. Indicia on the tube wall adjacent the apertures provide an indication to the user of relative above-ground tee height for any aperture pair selected to be used. With or without a tee situated in the tee recess of the plunger, the finger tabs can be depressed inwardly by finger squeezing to adjustably displace the plunger in order to effect a change in the desired tee height setting.

With a ball in place at the top concave recess, the body can be hand forced comfortably downwardly to effect ground penetration of the tee until the flared base bottom engages the ground surface. In the course of forcing the body downward, the tee effects a ground penetration which functions to exert a ground friction force to retain the tee against subsequent withdrawal of the apparatus. The height of the remaining ground inserted tee would then be correlated to the plunger setting prior to removal of the setting apparatus. With each golf stroke, the plunger height can be readily reset as desired by merely squeezing the button finger tabs toward each other in a release relation to the aperture interlock enabling the plunger to be slid longitudinally in either direction.

Being that the entire unit is about $\frac{3}{4}$ inches in diameter,.on the order of about $2\frac{1}{2}$ inches in length, and constructed of lightweight material, it can conveniently and comfortably be carried in either a trouser pocket or in the golf bag. By virtue of the squeeze button setting, tee height can be readily preset within a time frame on the order of about 3 seconds while by virtue of having only two components both constructed of molded polymer plastic composition, manufacturing cost is relatively low as compared to similar purpose devices of the prior art.

It is therefore an object of the invention to provide a novel setter apparatus for inserting and setting the height of golf tees.

It is a further object of the invention to effect the foregoing object with a construction affording the combined advantages of being easily handled, lightweight, easily adjusted and of relatively low manufacturing cost so as to render the apparatus readily affordable by all those who play the game.

The above noted features and advantages of the invention as well as other superior aspects thereof will be further appreciated by those skilled in the art upon reading the detailed description which follows in conjunction with the drawing.

DESCRIPTION OF THE PREFERRED EMBODIMENT

Figure 1:
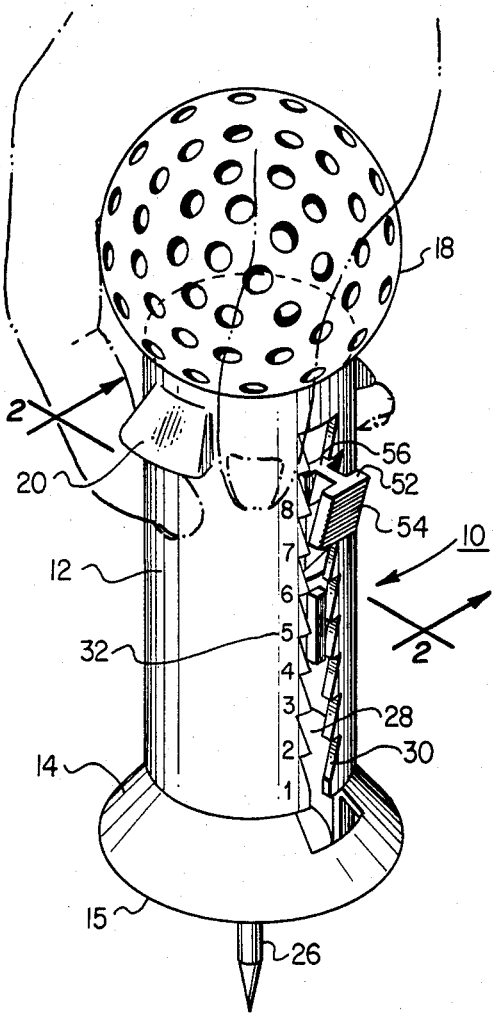
FIG. 1 is an isometric exterior elevation of the golf tee setter apparatus thereof.

In the description which follows, like parts are marked throughout the specification and drawing with the same reference numerals, respectively. The drawing figures are not necessarily to scale and in certain views parts may be rotated into the plane of the drawing for purposes of clarity.

Referring now to the drawings, the golf tee setter apparatus hereof is generally designated 10 and is comprised of an elongated tubular sleeve-like body 12 having an internal wall surface 13. At its lower extremity body 12 includes a skirted or flared base 14 defining a base plane 15. A concave inwardly dished exterior surface 16 at the top serves to temporarily accommodate a golf ball 18 to aid in hand insertion of a tee as will be understood. Also defined thereat is a pair of opposed protrusions 20 defining a finger grip to aid in removing apparatus 10 after tee insertion has been completed.

Formed in body 12 for purposes hereof are a pair of elongated longitudinal slots 28 oppositely located and centrally contained between a plurality of series arranged dovetail shape apertures 30. Adjacent each of the apertures is a reference indicia 32 for indicating the relative position of plunger 24 and a golf tee 26 releasably contained therein. The underside of skirt 14 from plane 15 is open ended at 22 in order to receive a displaceably slidable plunger 24 in which to contain a tee 26 to be set.

Comprising plunger 24 is a cylindrical body portion 34 containing at its underside a jaw-like, cylindrical recess 36 chamfered at the entrance 38 and through which to receive and releasably support a tee 26. For the purpose of releasably retaining a tee, recess 36 includes uniformly spaced internally projecting wedge-shaped posts 40, 42, the latter of which also include outward rectangular posts 44 for cooperation with slots 28 in a manner as will be understood. Each wedge-shape interface of the posts 40, 42 is slightly tapered inwardly in an axial direction from chamfer 38 until merging with the inside face of cap 46. An aperture 48 centrally extending through cap 46 provdes for exterior venting of air trapped between the tee head and the cap 46.

For adjustably setting the position of plunger 24 there is provided extending integrally upward therefrom a pair of relatively thin elongated arms 50. At their distal end each arm supports a lateral extension that includes a button 52 knurled or otherwise abraded as a finger grip along its forward finger face 54. For supporting button 52 on arm 54 and intervening therebetween there is provided a laterally positioned protrusion 56 having downwardly tapered sides 58 in order to define a complementary interfit with the dovetail apertures 30. Joining button 52 with protrusion 56 and providing structural reinforcement therefor is an elongated centrally located reinforcing flange or web brace 60 inwardly tapered downward to a location below button 52.

Figure 2:
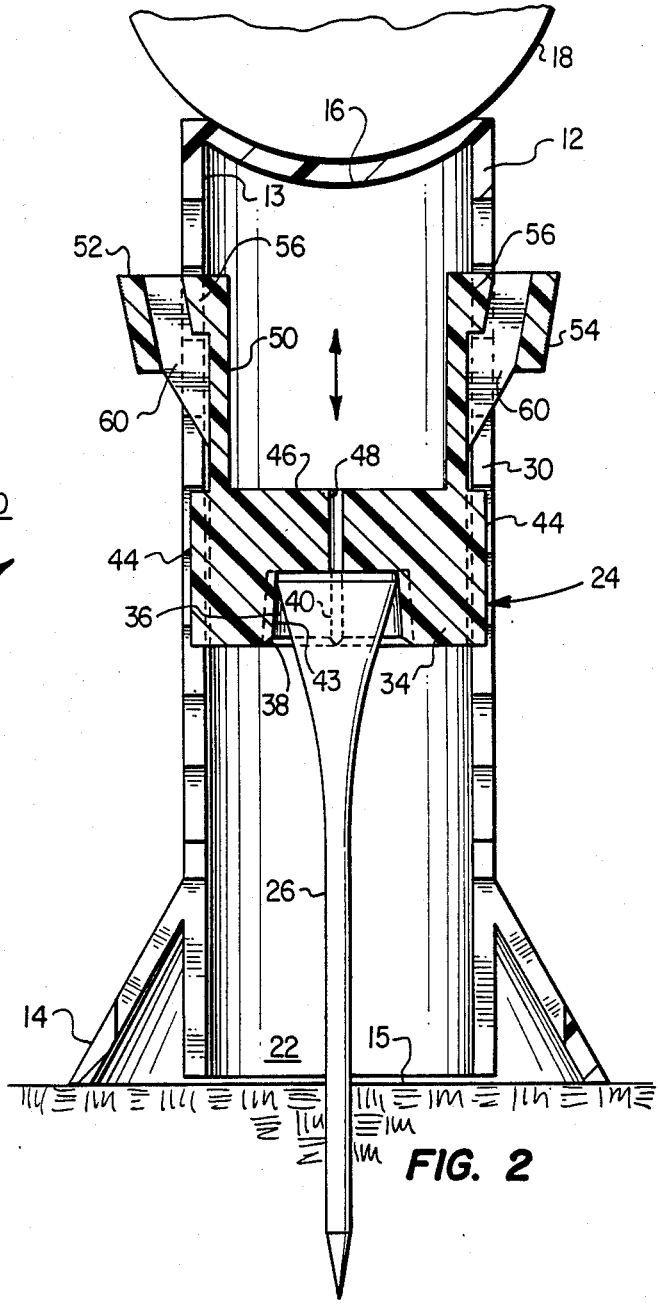
FIG. 2 is a sectional elevation taken substantially along the line 2—2 of FIG. 1 for the apparatus in its adjustably set position.
Figure 3:
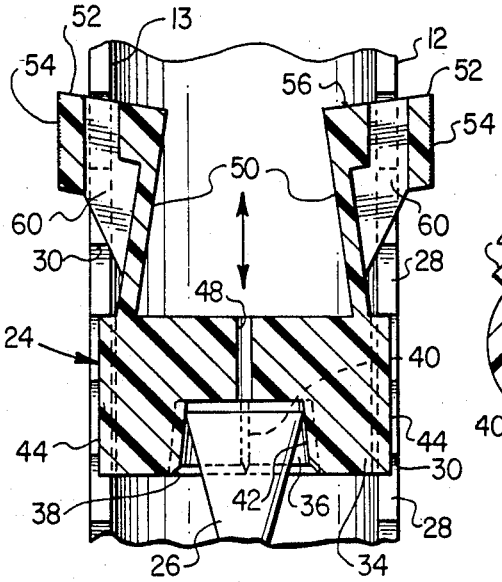
FIG. 3 is a fragmentary representation of the apparatus of FIG. 2 in a release position for adjustable reset.
Figure 5:
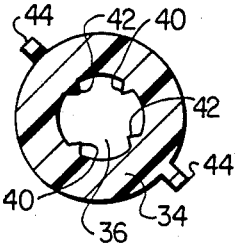
FIG. 5 is an underside plan view of the plunger of FIG. 4
Figure 4:
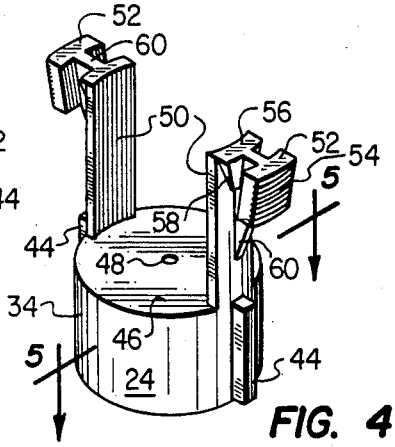
FIG. 4 is an isometric illustration of the plunger unit.

In the normal preset position of plunger 24, arms 50 stand substantially vertical and parallel to the inside face 13 of body 12. In that relation, the webs 60 extend through central slots 28 while protrusion 56 are complementarily positioned and longitudinally interlocked in one of the dovetail apertures 30 and buttons 52 are outward of body 12. In that arms 50 are thin and at their lower end extend integrally from a connection with plunger cap 46, they enjoy a resilient springlike quality about their joinder location. When buttons 52 are concomitantly squeezed inwardly, from the position of FIG. 2 to the position of FIG. 3, the arms bend inwardly until the respective protrusions 56 are inwardly clear of body surface 13. When in this relation, by means of a finger squeeze being held on buttons 52, the entire plunger unit can be moved vertically to any desired reset position corresponding to one of the selected dovetail apertures 30 at which the buttons can be released and restored to the relation of FIG. 2.

In the course of reset, both posts 44 and webs 60 ride clear in the opening of opposite slots 28. With a golf tee 26 inserted into recess 36 the tee head is frictionally gripped by the wedge faces of posts 40 and 42. By a squeezing action imposed on button faces 54 when in the relation illustrated in FIG. 3, the entire plunger 24 can be conveniently displaced up or down within body 12 relative to base plane 15 of skirt 14. In the course of displacing plunger 34, post 44 and web 60 are slidably moved and guided within slots 28 and at such time as the desired setting has been arrived at, buttons 52 can be released so as to allow an interlock relation to be incurred between protrusion 56 and the aperture 30 thereat in the manner illustrated in FIG. 2.

In operation, the head of a tee 26 is placed in recess 36 of plunger 34 after buttons 52 are finger depressed inwardly until cleared for vertical displacement. The relative height setting of tee 26 can then be positioned by displacing the plunger vertically until a correlated aperture 30 is selected for receipt of button protrusions 56. After releasing the buttons, it is only necessary to force a penetration of tee 26 into the ground at the desired location until plane 15 of skirt 14 is substantially ground flush. To aid in hand forcing penetration, a golf ball 18 can be positioned in dished surface 16 and with the golfer's hand placed on the ball, body 12 can be comfortably forced downward for effecting ground penetration by the tee. After tee penetration has been completed, ball 18 and body 12 are lifted upwardly by placing fingers under tabs 20 to remove the apparatus while tee 26 remains in place. By virtue of the ground friction imposed on the shank of tee 26, it readily detaches from the apparatus 10 as the latter is being removed and remains at the height setting determined by the preadjusted setting of plunger 24. Should it turn out that the height setting is not entirely to the suiting of the participant, it can subsequently be adjusted by hand or alternatively can be replaced into the unit 10 which is then readjusted as appropriate and repeatedly utilized as before to implant the tee 26 into the ground.

By the above description there is disclosed a novel golf tee setter apparatus that represents the height of simplicity in use and construction. In the preferred embodiment, the entire unit is comprised of only two molded parts formed of a polymer plastic composition so as to render the manufacturing cost thereof relatively low. The unit is sufficiently compact in size and lightweight so as to enable it to be carried either in a trouser pocket or golf bag and does not require any special skill to operate. Typically, one hand operation is all that is required, and when withdrawn, the ground held tee is prepared to immediately receive ball 18 for proceeding with the ensuing golf stroke. Operation is quick and easy and yet the entire unit is durable and long lasting so as to have a relatively long life expectancy and comparable long enjoyable period of use. Being that the entire unit is so relatively inexpensive, several can be comfortably afforded by the golf participant and carried with him at all times in the event one should get inadvertently misplaced.

Since many changes could be made in the above construction and many apparently widely different embodiments of this invention could be made without departing from the scope thereof, it is intended that all matter contained in the drawings and specification shall be interpreted as illustrative and not in a limiting sense.

I claim:

1. A tee setting apparatus for ground inserting and height setting of a golf tee on which a golf ball is to be supported for participation in the sport of golf, said tee setting apparatus comprising:

(a) an elongated tubular sleeve-like body extending from a base plane for a predetermined longitudinal length and including at least one longitudinal slot defined in a surface of said body;

(b) a plurality of separate apertures formed in communication with and arranged progressively positioned longitudinally along said slot, each of said apertures having a selected geometric perimeter capable of longitudinally interlocking an appropriately shaped protrusion received therein;

(c) a plunger slidably contained in said body and including a tee gripping recess in which to releasably support the head of a golf tee positioned axially therein; and (d) adjustment means connected to said plunger and including a geometric protrusion adapted to cooperate with said slot and apertures in order to be received and displaced from an interlock relation with a selected one of said apertures, said protrusion when displaced from said aperture enabling longitudinal displacement of said plunger relative to the base plane of said body and when received in a selected of said apertures effecting a longitudinal interlock therewith for setting a correlated height of a tee to be inserted from said recess into the ground by means of a ground directed force imposed on said body.

2. A tee setting apparatus according to claim 1 in which said body includes a pair of said slots oppositely aligned and each having said apertures longitudinally associated therewith and said adjustment means includes a pair of said geometric protrusions with one of said pair of protrusions being cooperative with a respective one of said slots and apertures.

3. A tee setting apparatus according to claim 2 in which said protrusions are resiliently connected to said plunger so as to be hand displaceable inwardly of said body from the aperture in which it is positioned.

4. A tee setting apparatus according to claim 3 in which said protrusions are concomitantly displaceable inwardly and there is provided laterally outward on each of said protrusions a finger grip displaceable by finger force toward said slot to enable axial displacement of said plunger.

5. A tee setting apparatus according to claim 4 in which the outer upper surface of said body includes a concave configuration for supporting a golf ball to aid in hand forcing the body for ground insertion of a contained tee with said ground directed force.

6. A tee setting apparatus according to claim 4 in which the base plane of said body is defined by an annular skirt flared outwardly from an upward location on said body.

7. A tee setting apparatus according to claim 4 in which said plunger recess includes a plurality of inwardly extending wedge edged posts for slidably supporting a received tee head.

8. A tee setting apparatus according to claim 4 in which both said body and said plunger are comprised of a polymer plastic composition.

9. A tee setting apparatus according to claim 8 in which said adjustment means includes a pair of elongated cantilevered arms each joined with said plunger at one end and integrally supporting a respective of said protrusions at its distal end.

10. A tee setting apparatus according to claim 8 in which said finger grip includes a finger gripping texture on the laterally outermost surface thereof.

11. A tee setting apparatus according to claim 8 in which said plunger includes integral side posts for extending inward of said slots to provide plunger guidance in the course of plunger displacement within said body.

12. A tee setting apparatus according to claim 8 including indicia contained on said body juxtaposed to said apertures for providing a relative indication of tee height setting for the respective of said apertures when selected for interlocked receipt of the protrusion of said plunger.

13. A tee setting apparatus according to claim 8 including tabs oppositely located and extending outward of said body defining finger grips to aid in the gripped withdrawal of said body after tee insertion has been completed.

* * * * *